US009765988B2

(12) United States Patent
Bruhnke et al.

(10) Patent No.: US 9,765,988 B2
(45) Date of Patent: Sep. 19, 2017

(54) DRY WALL EXTRUSION GRILLE

(71) Applicants: Lynne Bruhnke, Massapequa Park, NY (US); Daniel Roeper, Garden City, NY (US)

(72) Inventors: Lynne Bruhnke, Massapequa Park, NY (US); Daniel Roeper, Garden City, NY (US)

(73) Assignee: Oemetrix, L.L.C., New Hyde Park, NY (US)

( * ) Notice: Subject to any disclaimer, the term of this patent is extended or adjusted under 35 U.S.C. 154(b) by 405 days.

(21) Appl. No.: 13/999,038

(22) Filed: Jan. 6, 2014

(65) Prior Publication Data

US 2015/0192320 A1 Jul. 9, 2015

(51) Int. Cl.

| | |
|---|---|
| ***F24F 7/00*** | (2006.01) |
| ***F24F 13/10*** | (2006.01) |
| ***F24F 13/08*** | (2006.01) |

(52) U.S. Cl.

CPC ..... *F24F 13/082* (2013.01); *F24F 7/00* (2013.01); *F24F 2007/003* (2013.01)

(58) Field of Classification Search

CPC ..... F24F 13/082; F24F 13/084

See application file for complete search history.

(56) References Cited

U.S. PATENT DOCUMENTS

| | | | | | |
|---|---|---|---|---|---|
| 943,298 | A * | 12/1909 | Brown | F24F 13/08 | 454/332 |
| 2,752,844 | A * | 7/1956 | Simblest | F24F 13/08 | 454/277 |
| 5,082,083 | A | 1/1992 | Draffen | | |
| 5,144,099 | A * | 9/1992 | Cardy | H02G 3/14 | 174/66 |
| 5,863,310 | A * | 1/1999 | Brown | B01D 46/0005 | 454/284 |
| 5,928,078 | A * | 7/1999 | Moore | F24F 13/068 | 285/341 |
| 5,950,384 | A * | 9/1999 | Aarness | F24F 13/075 | 454/277 |
| 6,234,894 | B1 * | 5/2001 | Goracke | F24F 13/082 | 454/290 |
| 6,908,115 | B2 * | 6/2005 | Synder | F24F 13/084 | 285/189 |
| 7,140,960 | B2 * | 11/2006 | Pilger | F24F 13/06 | 454/292 |
| 7,771,259 | B2 * | 8/2010 | Pettit | F24F 13/084 | 454/289 |
| 9,024,186 | B1 * | 5/2015 | Gonzalez | H02G 3/14 | 174/66 |
| 2004/0058638 | A1 * | 3/2004 | Achen | F24F 13/082 | 454/277 |
| 2007/0232217 | A1 * | 10/2007 | Davis | F24F 13/082 | 454/330 |

* cited by examiner

*Primary Examiner* — Steven B McAllister
*Assistant Examiner* — Jonathan Cotov
(74) *Attorney, Agent, or Firm* — Philip M. Weiss; Weiss & Weiss

(57) ABSTRACT

A dry wall extrusion grille comprising a frame, a liner bar grille, sheet rock screws, pre-perforated through holes, indented slots, and a flexible edge.

23 Claims, 4 Drawing Sheets

DRY WALL EXTRUSION GRILLE

FIELD OF THE INVENTION

The present invention relates to a dry wall extrusion grille comprising a frame, a liner bar grille, sheet rock screws, pre-perforated through holes, indented slots, and a flexible edge.

BACKGROUND OF THE INVENTION

U.S. Pat. No. 5,082,083 relates to a structure wall mounted speaker assembly. The woofer of the speaker is mounted in the assembly wall frame and the tweeter is both mounted in and self-contained within the assembly wall frame. The installation requires only that a circular opening be cut in the wall to enable the rear portion of the woofer to extend through the dry wall or sheetrock and two simple holes drilled in the wall to accommodate the support bolts to retain the wall mounted speaker assembly on the wall.

U.S. Pat. No. 7,140,960 relates to duct systems, registers and ductwork components used with floor or ceiling registers employed in warm air heating, ventilating and air conditioning systems, and improvements for mounting and installing components of the duct system, including register boots, mud rings and register grilles, in the walls, floors or ceilings of buildings components, mud ring, register grille and wall, floor or ceiling opening, which reduces costs.

U.S. Pat. No. 7,771,259 relates to a flush mounted frame for an access panel or register. The frame is mounted to a wall, ceiling or floor surface, is made by joining linear frame sections each providing interconnected elements formed by an extrusion process. A first planar element is spaced apart from a second planar element and positioned for abutting a common surface. A first channel element is formed between the first and second planar elements. A third planar element is positioned normal to the first and second planar elements and terminates with a rib directed toward the first planar element. When mounted onto studs in a building structure, wall putty or mud may be placed into a space between the wall panels and the third planar element, the mud is captured in place forming a smooth interface between the frame assembly and the surrounding wall surfaces.

SUMMARY OF THE INVENTION

The present invention relates to a dry wall extrusion grille.

The dry wall extrusion grille comprises a frame, a liner bar grille, sheet rock screws, pre-perforated through holes, indented slots, a flexible edge.

It is an object of the present invention for the indented slots to capture joint compound or plaster.

It is an object of the present invention for the flexible edge to be used for fastening to a wall or ceiling with pre-perforated through holes.

It is an object of the present invention for a common sheet rock screw to be threaded into the wall material.

It is an object of the present invention for the frame to be constructed of four mitered pieces. It is an object of the present invention for the four mitered pieces to be welded together.

It is an object of the present invention for the frame to be installed with a sheet rock screw before plaster or a joint compound is applied.

It is an object of the present invention for the dry wall extrusion grille to be installed to a wall with four sheet rock screws.

It is an object of the present invention for the extrusion grille to have pre-perforated mounting through holes providing many mounting options to address multiple field conditions.

It is an object of the present invention for the extrusion grille to be a fully welded construction that provides exceptional strength for mounting in both walls and ceilings It is an object of the present invention for the extrusion grille to have multiple, pre-punched mounting holes for fastening in a wide range of wall conditions and materials It is an object of the present invention for the extrusion grille to have multiple, pre-punched mounting holes for attachment to underlying studs (support beams) for a wide range of center to centers.

It is an object of the present invention for the extrusion grille to have pre-punched holes accurately sized for standard wall board/sheet rock screws so no special hardware or tools are required.

It is an object of the present invention for the extrusion grille to have multiple indented slots along the mounting flange to provide capture points for joint compound or plaster.

It is an object of the present for the extrusion grille to comprise flexible mounting flange that fasten the grille to uneven wall surfaces.

It is an object of the present invention for the inside of the extrusion grille frame to extend ¾" deep into the opening so that the extrusion grille is installed in a wall board or plaster ranging from about ¼" thru about ¾" thick.

It is an object of the present invention for the extrusion grille to allow an installer to cut a very rough hole in a wall and slip the extrusion grille frame into the opening. With the design of the present invention there is no routing or recessed cut that is necessary. With the design of the present invention there is no blocking or added wood necessary for attachment to wall.

It is an object of the present invention for the extrusion grille to provide exceptional strength using aluminum material—thus enabling safe use in ceiling applications.

It is an object of the present invention for the extrusion grille to be used with a fixed core (core welded directly to the frame or removable core for access to either controls or filtration behind the grille).

It is an object of the present invention for the extrusion grille to be used specifically for linear bar grilles, and not used with perforated grilles or registers.

It is an object of the present invention for the extrusion grille to be mounted, so that the entire frame and grille are flush to the wall providing a seamless installation—which makes field painting much easier—also makes future cleaning of the grille simpler as can be done with simply the wipe of a rag It is an object of the present invention for the extrusion grille to be mounted in only one way, so that it cannot be installed backward.

It is an object of the present invention for the extrusion grille to require four pieces for construction, providing faster assembly and lower cost.

It is an object of the present invention for the extrusion grille to have a special angled edge that provides a step for a standard spackle knife to rest when a plaster or joint compound is being applied. This creates a crisp, clean line set up for the application of the final skim coat of plaster (joint compound).

DETAILED DESCRIPTION OF THE INVENTION

Figure 1:
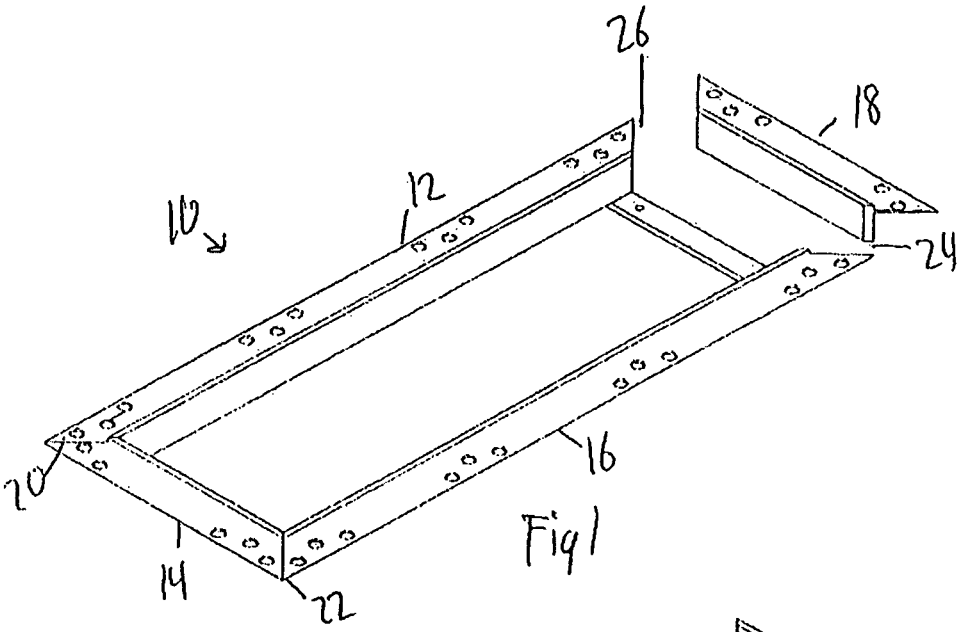
FIG. 1 is a top view of the frame of the present invention.
Figure 2:
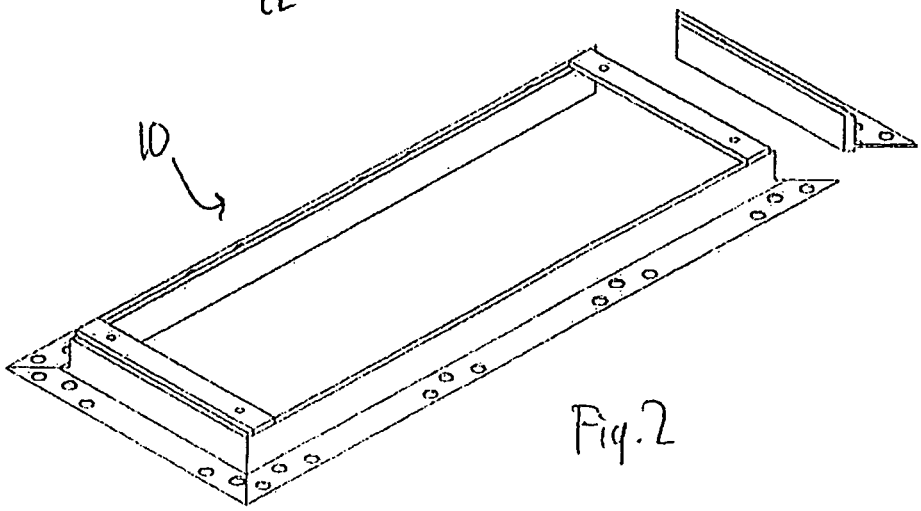
FIG. 2 is a bottom view of the frame of the present invention.

FIG. 1 shows the frame 10 comprising four mitered pieces 12, 14, 16 and 18, which are welded at 20, 22, 24, and 26. FIG. 2 shows the bottom view of frame 10 of FIG. 1.

Figure 3:
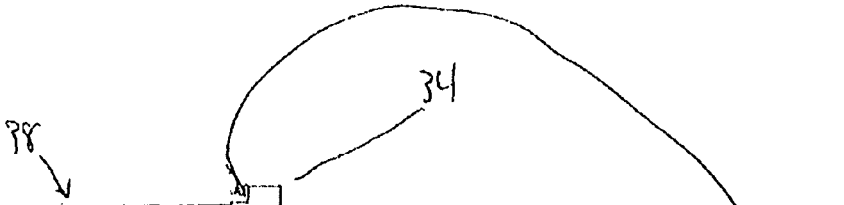
FIG. 3 is side view of the flexible edge of the present invention.
Figure 4:
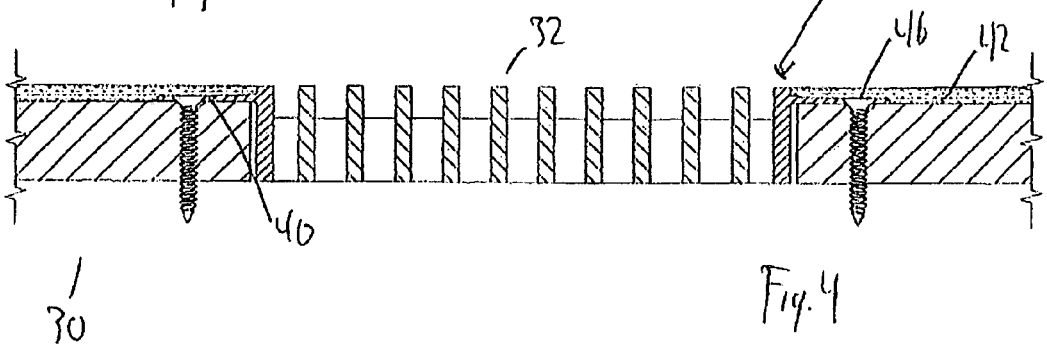
FIG. 4 is a cross sectional view of the extrusion grille of the present invention.

FIGS. 3 and 4 show the extrusion grille 30, which comprises a linear bar grille 32. The extrusion grille 30 has an aluminum profile 34, a flexible mounting flange 36 that is used for fastening to a wall or ceiling with perforated through holes 40. The extrusion grille 30 further comprises indented slots 38 used to capture joint compound or plaster 42.

Extrusion grille 30 further comprises a special angled edge 44 to create a step for a spackling knife to use as a straight edge. A common sheet rock screw 46 is threaded into the wall material.

Figure 5:
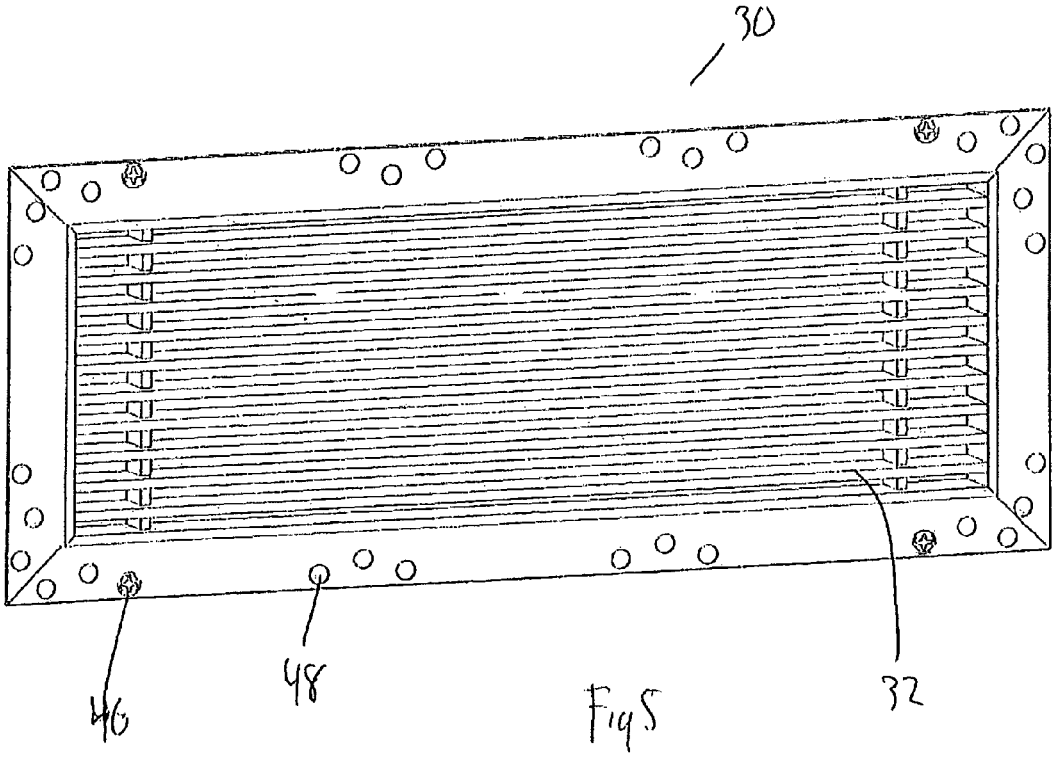
FIG. 5 is a front view of the extrusion grille of the present invention.

FIG. 5 shows the extrusion grille 30 having the linear bar grille, a standard sheet rock screw 46, and pre-perforated mounting through holes that provide many mounting options to address multiple field conditions.

Figure 6:
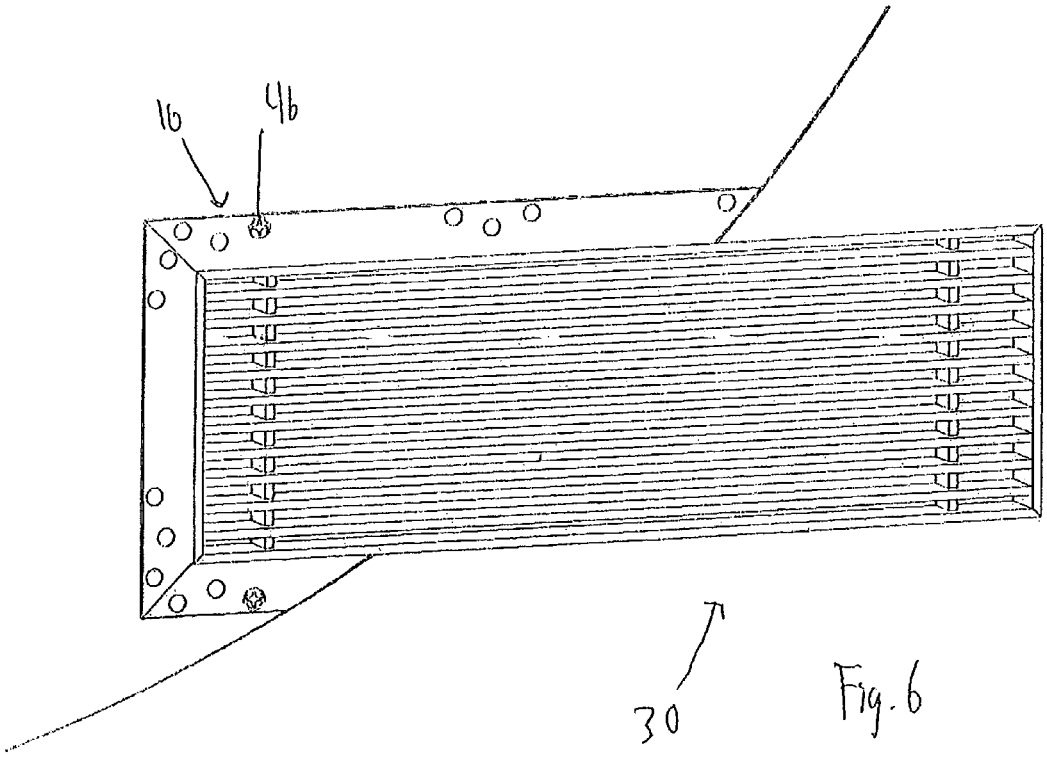
FIG. 6 is a front view of the extrusion grille of the present invention.

FIG. 6 shows the extrusion grille 30 installed after the plaster or joint compound is applied. The frame 10 is installed with the sheet rock screw 46 before plaster or joint compound is applied.

The invention claimed is:

1. A dry wall extrusion grille comprising:

a frame, a linear bar grille located in said frame comprised of vanes and cross members that direct a flow of air, pre-perforated through holes, indented slots, and a flexible mounting flange located between a top and bottom edge of the frame and extending outwardly from said frame;

said indented slots defined as small recesses in said flexible mounting flange that receive plaster, joint compound or mud, said pre-perforated through holes located in the flexible mounting flange.

2. The extrusion grille of claim 1 wherein said flexible mounting flange is fastened to a wall or ceiling with said pre-perforated through holes.

3. The extrusion grille of claim 1 further comprising sheet rock screws.

4. The extrusion grille of claim 3 wherein said frame is installed with said sheet rock screw before plaster or a joint compound is applied.

5. The extrusion grille of claim 4 wherein said extrusion grille is installed to a wall with four sheet rock screws.

6. The extrusion grille of claim 1 wherein said frame is constructed of four mitered pieces welded together.

7. The extrusion grille of claim 1 wherein said pre-perforated mounting through holes provide multiple mounting options to address multiple field conditions.

8. The extrusion grille of claim 1 wherein said extrusion grille is a fully welded construction.

9. The extrusion grille of claim 1 wherein said extrusion grille comprises multiple, pre-punched mounting holes for fastening in a wide range of wall conditions and materials.

10. The extrusion grille of claim 1 wherein said extrusion grille comprises multiple, pre-punched mounting holes for attachment to underlying studs (support beams).

11. The extrusion grille of claim 1 wherein said extrusion grille comprises pre-punched holes accurately sized for standard wall board/sheet rock screws so no special hardware or tools are required.

12. The extrusion grille of claim 1 wherein said flexible mounting flange fastens said extrusion grille to uneven wall surfaces.

13. The extrusion grille of claim 1 wherein inside of said extrusion grille frame extends about ¾" deep into opening so that said extrusion grille is installed in a wall board or plaster ranging from about ¼" thru about ¾" thick.

14. The extrusion grille of claim 1 wherein said extrusion grille allows an installer to cut a rough hole in a wall and slip said extrusion grille frame into said hole.

15. The extrusion grille of claim 1 wherein no routing or recessed cut is necessary.

16. The extrusion grille of claim 1 wherein there is no blocking or added wood necessary for attachment to wall.

17. The extrusion grille of claim 1 wherein said extrusion grille is comprised of aluminum material.

18. The extrusion grille of claim 1 wherein said extrusion grille is used with a fixed core, a core welded directly to said frame or removable core for access to controls or filtration behind said grille.

19. The extrusion grille of claim 1 wherein said extrusion grille is mounted, so that said entire frame and grille are flush to a wall providing a seamless installation.

20. The extrusion grille of claim 1 wherein said extrusion grille is mounted in only one way, so that it cannot be installed backward.

21. The extrusion grille of claim 1 wherein said extrusion grille has a special angled edge that provides a step for a standard spackle knife to rest when a plaster or joint compound is being applied.

22. The extrusion grille of claim 1 wherein said extrusion grille has a special angled edge that provide a crisp, clean line set up for application of final skim coat of plaster (joint compound).

23. The extrusion grille of claim 1 wherein said extrusion grille is flush mounted to a wall without requiring a stud.

* * * * *